US008235440B2

(12) United States Patent
Park

(10) Patent No.: US 8,235,440 B2
(45) Date of Patent: Aug. 7, 2012

(54) STUDYING CHOPSTICK FOR DEVELOPING CHILDREN'S INTELLECTUAL POWERS

(76) Inventor: Byoung Jin Park, Bucheon (KR)

( * ) Notice: Subject to any disclaimer, the term of this patent is extended or adjusted under 35 U.S.C. 154(b) by 963 days.

(21) Appl. No.: 11/668,078

(22) Filed: Jan. 29, 2007

(65) Prior Publication Data

US 2007/0187962 A1 Aug. 16, 2007

Related U.S. Application Data

(63) Continuation-in-part of application No. 10/477,827, filed on Nov. 17, 2003, now abandoned.

(30) Foreign Application Priority Data

Aug. 14, 2001 (KR) ..... 2001/49096
Jul. 29, 2002 (KR) ..... 2002/44749

(51) Int. Cl.
*A47J 45/00* (2006.01)
*A47G 21/10* (2006.01)

(52) U.S. Cl. ..... 294/218; 294/99.2

(58) Field of Classification Search ..... 294/1.1, 294/33, 25, 99.2, 218, 219
See application file for complete search history.

(56) References Cited

U.S. PATENT DOCUMENTS 4,199,180 A * 4/1980 Kelly ..... 294/33
2002/0096899 A1* 7/2002 Kang ..... 294/99.2

FOREIGN PATENT DOCUMENTS

GB 2065454 * 7/1981
KR 20-0253470 * 11/2001

* cited by examiner

*Primary Examiner* — Paul T Chin

(57) ABSTRACT

A pair of training chopsticks for developing intellectual faculties is described. The training chopsticks include a first stick and a second stick. The first stick has a thumb-inserting hole for inserting the thumb and a first pad for picking up solids. The thumb-inserting hole is formed on the upper side of the first stick and the first pad is formed on the lower end of the first stick. The second stick has a holding unit for inserting the forefinger and the second finger. The holding unit has a forefinger-inserting hole for inserting the forefinger and a second finger-inserting hole for inserting the second finger.

3 Claims, 11 Drawing Sheets

STUDYING CHOPSTICK FOR DEVELOPING CHILDREN'S INTELLECTUAL POWERS

CROSS REFERENCE TO RELATED APPLICATION

This application is a continuation-in-part of U.S. patent application Ser. No. 10/477,827 for "Studying Chopstick for Developing Children's Intellectual Powers" filed on Nov. 17, 2003 now abandoned.

CLAIMING FOREIGN PRIORITY

The applicant claims and requests a foreign priority, through the Paris Convention for the Protection of Industrial Property, based on patent applications filed in the Republic of Korea (South Korea) with the filing date of Aug. 14, 2001 with the patent application number 2001/49096 and with the filing date of Jul. 29, 2002 with the patent application number 2002/44749 by the applicant, the contents of which are incorporated by reference into this disclosure as if fully set forth herein.

BACKGROUND OF THE INVENTION (1) Field of the Invention

The present invention relates to chopsticks for developing intellectual faculties, more particularly to a pair of training chopsticks having a removable coupling member formed between the upper sides of the first and the second stick, a thumb-inserting ring formed on the first stick, a forefinger and second finger-inserting ring formed on the second stick, and removable pads for picking up solids formed on the lower sides of the first and the second stick. The training chopsticks are of good use to novice or child users who make poor use of chopsticks.

the present invention relates to a chopstick, more particularly the present invention relates to the chopstick which enables the children and people of non-East Asian origin who are not good at using thereof to use chopsticks at first try by equipping a detachable coupling means for connecting a pair of sticks and equipping a detachable battery and middle finger-inserting hole on a first stick and equipping a detachable thumb or third finger inserting hole or finger-laying part on a second stick.

(2) Description of the Related Arts

Chopsticks, widely used throughout Asia as an eating utensil, are effective in exercising the joints of fingers or wrists. Moreover, chopsticks are known to be effective in developing children's intelligence, specially, during their growth period, because the moving of fingers can arouse their brains.

However, chopsticks can be difficult and frustrating to use for novice users suffering from a disability, and are rarely used by children.

A number of inventions have been developed to assist the use of chopsticks. The Japanese Patent specification of No. 10-137101 describes a pair of training chopsticks on which rings for inserting fingers are formed. Referring to FIG. 1, the rings 11, 12, 21, 22 are formed on the chopsticks 10, 20, and inclined to insert fingers suitably. Marks for indicating the finger to be inserted into each ring are recorded on the rings, and arrows are marked on each top of the chopsticks in order to indicate the direction for grasping.

However, the chopsticks has many problems as follows:

Firstly, the rings 21, 22 for inserting the forefinger and the second finger and fixed on the side surface of the sticks respectively and are formed on the same level as the stick.

That is, since the inserting structure of the forefinger and the second finger-inserting rings takes planner form, it is difficult to use the chopstick in a correct pose and brings about a malformed pose.

Secondly, since the chopsticks has not a coupling part (e. g, hinge) between two sticks, novice users cannot use the chopsticks easily.

Thirdly, since the chopsticks is formed as one body, it is impossible to learn the use of chopsticks step by step.

Fourthly, the chopsticks should be made in various forms according to the size of the fingers.

Fifthly, since the rings 21, 22 are fixed on the chopsticks, the chopsticks should be made in various form according to the size of the fingers. Further, it is difficult to insert fingers into the rings, since the inserting angle for the rings is steep.

Korea utility model No. 2001-23369 describes more improved training chopsticks. Referring FIG. 2, the upper sides of the chopsticks 50*a*, 50*b* are connected to each other by a connecting member 51 including the hinge 51'. A grasp ring for the thumb 51 is formed on the chopstick 50*a*, and a grasp ring for the forefinger 52 and a grasp ring for the second finger 53 are formed on the other chopstick 50*b*. The grasp rings 51, 52, 53 are inclined with respect to the chopsticks to fit the inserting angle of the fingers. A grasping part 55 has the grasp ring for the forefinger 52 and the grasp ring for the second finger 53 which are formed in a body. The grasping part 55 can be adjusted up and down with coupling to the stick. A plurality of male screw is formed on the outside of the chopstick 50*b* and a plurality of female screws is formed on the inside of the grasping part 55. The fixing position of the grasping part 55 moves up and down by matching a male screw and a female screw, so that the grasping part 55 can be adjusted to fit the finger size of users.

Even though above described training chopsticks are some help to novice or child users, but it take much time to train the use of chopsticks. Further, above described chopsticks don't arouse children interest in the use of chopsticks.

The present invention has been developed to solve the problems with above-described chopsticks.

SUMMARY OF THE INVENTION

It is an object of the present invention to provide a pair of training chopsticks for giving novice or child users training how to use chopsticks easily.

It is another object of the present invention to provide a pair of training chopsticks for learning how to use chopsticks step by step.

According to one aspect of the present invention there is provided a pair of training chopsticks for developing intellectual faculties. The training chopsticks comprise a first stick, a second stick and a coupling means.

The first stick has a thumb-inserting ring for inserting the thumb and a first pad for picking up solids. The thumb-inserting ring is formed on the upper side of the first stick and the first pad is formed on the lower end of the first stick, and the thumb-inserting ring is inclined at a predetermined angle with respect to the horizontal direction of the first stick.

The second stick has a holding part formed in the middle of it, and a second pad for picking up solids. The holding part has a forefinger-inserting ring for inserting the forefinger and a second finger-inserting ring for inserting the second finger, and the second finger is formed on the lower end of the second stick.

The coupling means is formed on the upper sides of the first and second stick and couples the first and second stick at an interval.

The coupling means comprises a first coupling member, a second coupling member and a cap.

The first coupling member has a first coupling body fixed on the upper side of the first stick, a coupling ring formed as one body with the first coupling body, and a holder formed on the coupling ring.

The second coupling member has a second coupling body fixed on the upper side of the second stick, a rotation ring formed as one body with the second coupling body, a projecting part formed on the rotation ring and inserted into the coupling ring, and a holding groove formed on the rotation ring and engaged with the holder.

The cap is fixed into the hole of the second coupling member, after the first coupling member and the second coupling member are coupled.

Alternatively, a portion of the thumb-inserting ring, the forefinger-inserting ring and the second finger-inserting ring may be opened respectively.

According to another aspect of the present invention, there is provided a pair of training chopsticks for developing intellectual faculties.

The training chopsticks comprises a first stick, a second stick, a coupling means, and a luminous means.

The first stick has a thumb-inserting ring for inserting the thumb, a first pad for picking up solids and an ornament of a character form. The thumb-inserting ring is formed on the upper side of the first stick, the first pad is formed on the lower end of the first stick, and the ornament is formed on the upper end of the first stick.

The second stick has a holding part for inserting the forefinger and the second finger an adjusting means for adjusting the coupling position of the holding part and a second pad for picking up solids. The holding part has a forefinger-inserting ring for inserting the forefinger and a second finger-inserting ring for inserting the second finger. The second pad is formed on the lower end of the second stick.

The coupling means formed on the upper sides of the first and the second stick couples the first and the second stick at an interval.

The luminous means emits light through the ornament. The luminous means is formed in the ornament and controlled by the pressure between the first and the second pad.

The luminous means includes a pressure sensor and emits light in response to the moving of the chopsticks.

And an objective of the present invention is to provide a chopstick for a user to learn how to use the chopstick step by step by providing a structure of a detachable coupling means on the upper part of first and second stick which comprises a detachable finger inserting holes and finger laying parts or chopsticks.

Another objective of the present invention is to prevent the rotation of the finger inserting holes and finger laying part by forming a rotation-preventing part on the first and second sticks.

A further objective of the present invention is to make attaching a flap for decoration easier by forming a key protruded on the latter part of the flap for decoration constituting a coupling means and making a key hole for engaging with the key formed on a fixed Coupling part.

DETAILED DESCRIPTION OF THE EMBODIMENTS

Figure 1:
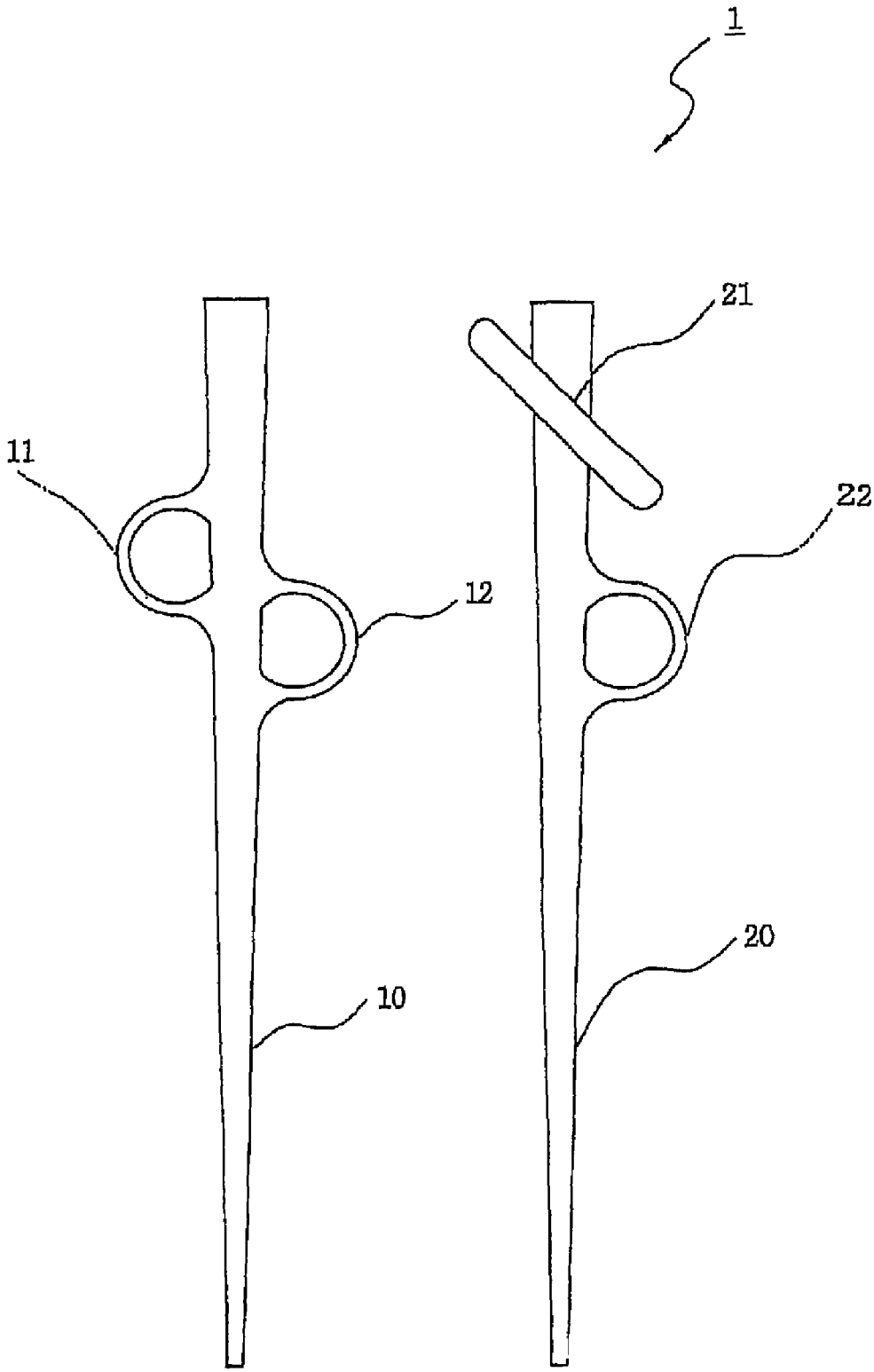
FIG. 1 (Prior Art)
FIG. 1 is a schematic view showing the chopsticks according to the prior art.
Figure 2:
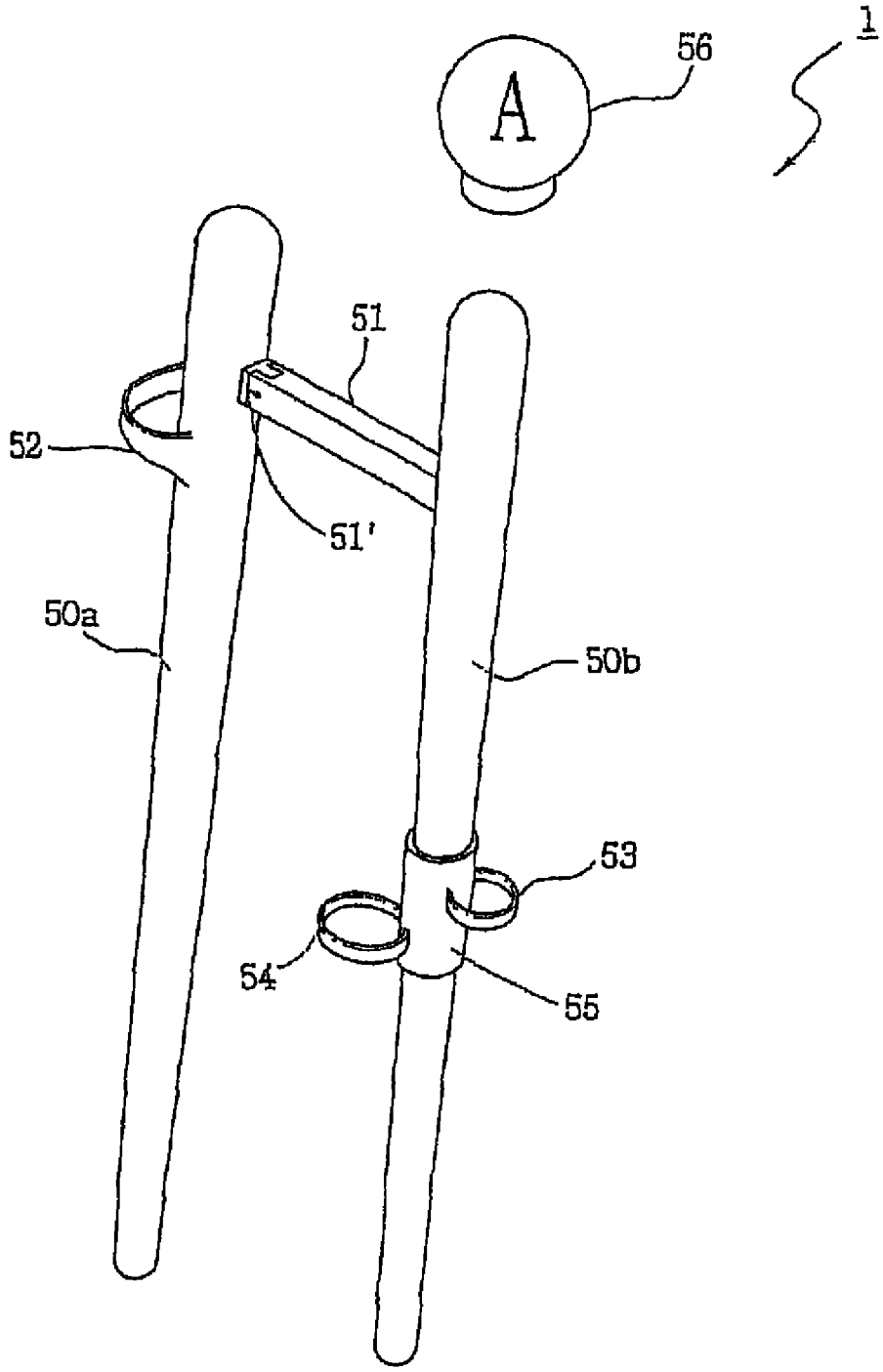
FIG. 2 (Prior Art)
FIG. 2 is a perspective view showing another chopsticks according to the prior art.

Referring now to attaching the drawings, the training chopsticks according to an embodiment of the present invention will be described in detail. It is noted that like parts are designated by like reference numerals throughout the accompanying drawings.

Figure 3:
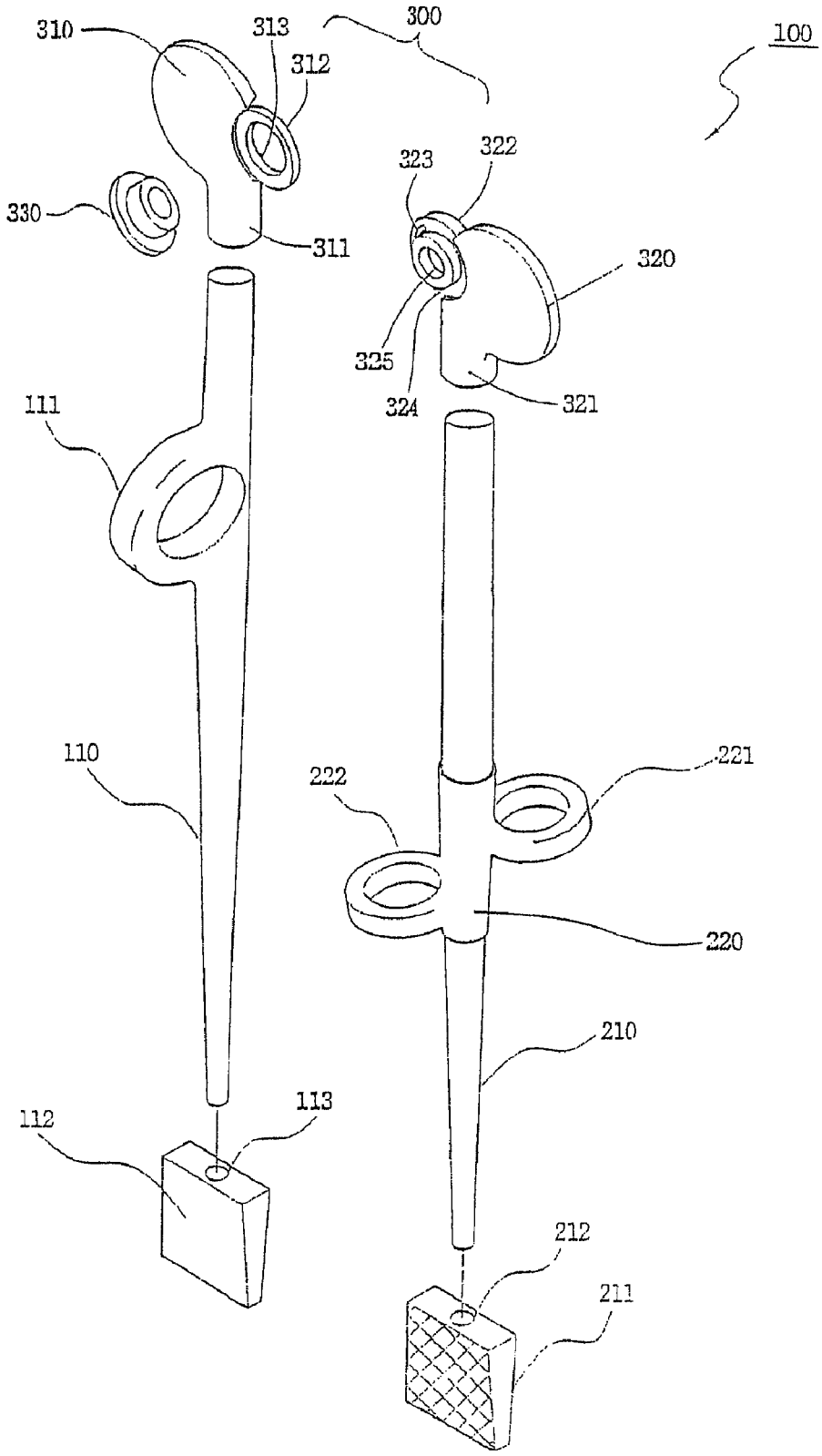
FIG. 3 is an illustrated perspective view showing the training chopsticks according to an embodiment of the present invention.

As shown FIG. 3, the training chopsticks 100 of the present invention comprises a pair of sticks 110, 210 with a coupling means 300.

A thumb-inserting ring 111 for inserting the thumb is formed on the upper side of the first stick 110, and a first pad 112 for picking up solids is formed on the lower end of the first stick 110. The thumb-inserting ring 111 is inclined at a predetermined angle with respect to the horizontal direction of the first stick 110.

A holding part 220 is formed in the middle of the second stick 210, and a second pad 211 for picking up solids is formed on the lower end of the second stick 210. The holding part 220 comprises a forefinger-inserting ring 221 for inserting the forefinger and a second finger-inserting ring 222 for inserting the second finger.

The coupling means 300 for coupling the first and the second stick 110, 210 is formed on the upper sides of the first and the second stick 110 210. The interval between the first and the second stick 110, 210 is kept uniformly by the coupling means 300.

Figure 4A:
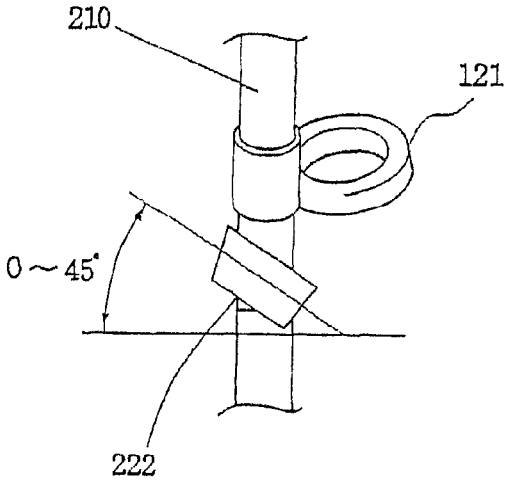
FIGS. 4*a* and 4*b* are perspective views showing a forefinger-inserting ring and a second finger-inserting ring of the training chopsticks according to the embodiment of the present invention.
Figure 4B:
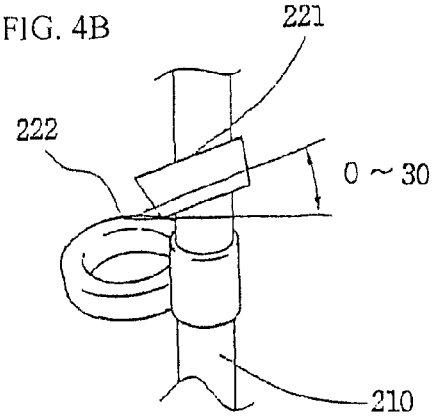

In order to inserting smoothly fingers into the rings 111, 221, 222, the thumb-inserting ring 111 is inclined at 10~35 degrees with respect to the horizontal direction of the first stick 110. Similarly, as shown FIG. 4*a*, the second finger-inserting ring 222 is inclined at 0~45 degrees with respect to the perpendicular direction of the second stick 210, and as shown FIG. 4*b*, the forefinger-inserting ring 221 is inclined at 0~30 degrees with respect to the perpendicular direction of the second stick 210.

Figure 5:
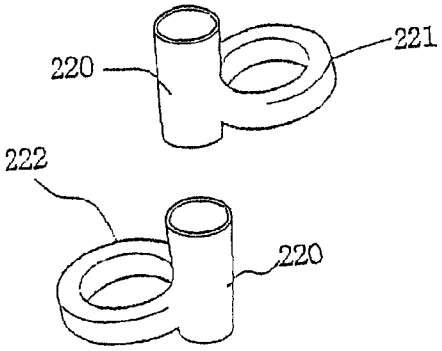
FIG. 5 is a perspective view showing separately the forefinger-inserting ring and the second finger-inserting ring of the training chopsticks according to the embodiment of the present invention.

As shown FIG. 5, the forefinger-inserting ring and the second finger-inserting ring 221, 222 are made of silicon, soft plastic or elastic materials.

Figure 6:
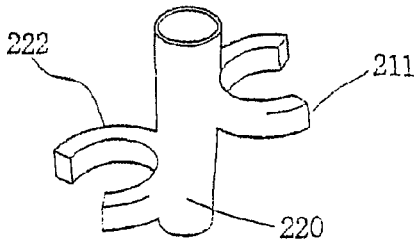
FIG. 6 is a perspective view showing another forefinger-inserting ring and second finger-inserting ring of the training chopstick according to the embodiment of the present invention.

Alternatively, as shown FIG. 6, each ring has an opening to insert large fingers. Therefore, a man of large fingers also can use the chopsticks easily.

Figure 7A:
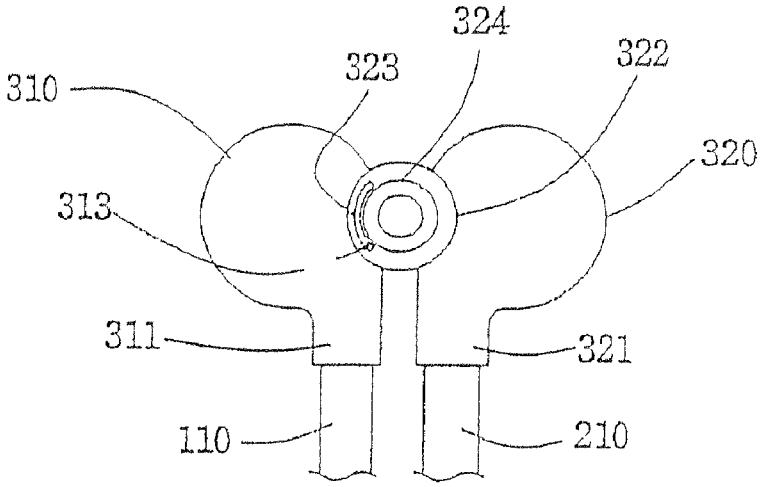
FIGS. 7*a* and 7*b* are schematic views showing a part of a coupling means of the training chopsticks according to the embodiment of the present invention.
Figure 7B:
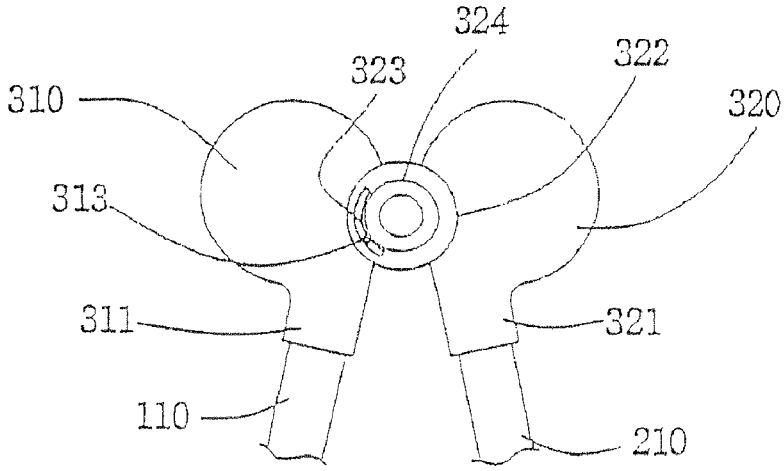

Referring to FIGS. 3, 7*a* and 7*b*, it is described the coupling means 300 which comprises a first coupling member 310, a second coupling member 320 and a cap 330.

The first coupling member 310 has a first coupling body 311 fixed on the upper side of the first stick 110, a coupling ring 312 formed as one body with the first coupling body 311, and a holder 313 formed on the coupling ring 312.

The second coupling member 320 has a second coupling body 321 fixed on the upper side of the second stick 210, a rotation ring 322 formed as one body with the second coupling body 321, a projecting part 324 formed on the rotation ring 322. The projecting part 324 is inserted into the coupling ring 312, and a holding groove 323 engaged with the holder 313 is formed on the rotation ring 322.

The cap 330 is fixed into the hole 325 of the second coupling member 320, after the first coupling member 310 and the second coupling member 320 are coupled.

After being practiced in manipulating the chopsticks, the coupling means 300 can be removed so that users are able to use the chopsticks without it.

Further, as shown FIG. 3, each inside surface of the first and the second pad 112, 211 is embossed for users to pick up solids easily, and inserting holes 113, 212 are formed in each center of the pads 112, 211 to insert the sticks 110, 210 After users are practiced in manipulating the chopsticks, the pads 112, 211 may be removed.

Alternatively, the pads 112, 211 may be formed in a body with the first and the second stick 110, 211 respectively.

In the using the chopsticks according to the present invention, the thumb is inserting into the thumb-inserting ring 111 of the first stick 110, and each of the forefinger and the second finger is inserted into the forefinger-inserting ring 221 and the second finger-inserting ring 222 of the second stick 210 respectively.

In the state of making two sticks 110, 211 narrower, as shown in FIG. 7*a*, the holder 313 of the coupling ring 312 is placed on the end of the holding groove 323. Next, as shown in FIG. 7*b*, when two sticks become far off each other, the holder 313 rotates along the holding groove 323. That is, the holder 313 is rotated under the guidance of the holding groove 323 so that two sticks 110, 211 is not passed each other.

As described above, the chopsticks of present invention has the coupling means 300 to connect the first and the second sticks 110, 210, so that novice or child users easily pick up solids with the chopsticks.

After being practiced in manipulating the chopsticks, users are able to use the chopsticks without the pads 112, 211, and moreover, to without the coupling means 300.

That is, according to the ability of manipulating chopsticks, the pads 112, 211 may be removed from the sticks 110, 210, and the sticks 110, 210 are separated by removing the coupling means 300.

In the first step, all parts of the chopsticks as shown FIG. 3 are used for grasping the sticks. In the second step, the pads 112, 211 are removed for training picking up solids. In the third step, the coupling means 300 is separated from the sticks for training the usage of sticks. In the last, the ring 111, 221, 222 are removed for using only two sticks.

As above described, the parts of the chopsticks can be used selectively so that novice or child users learn how to use chopsticks step by step.

Figure 8:
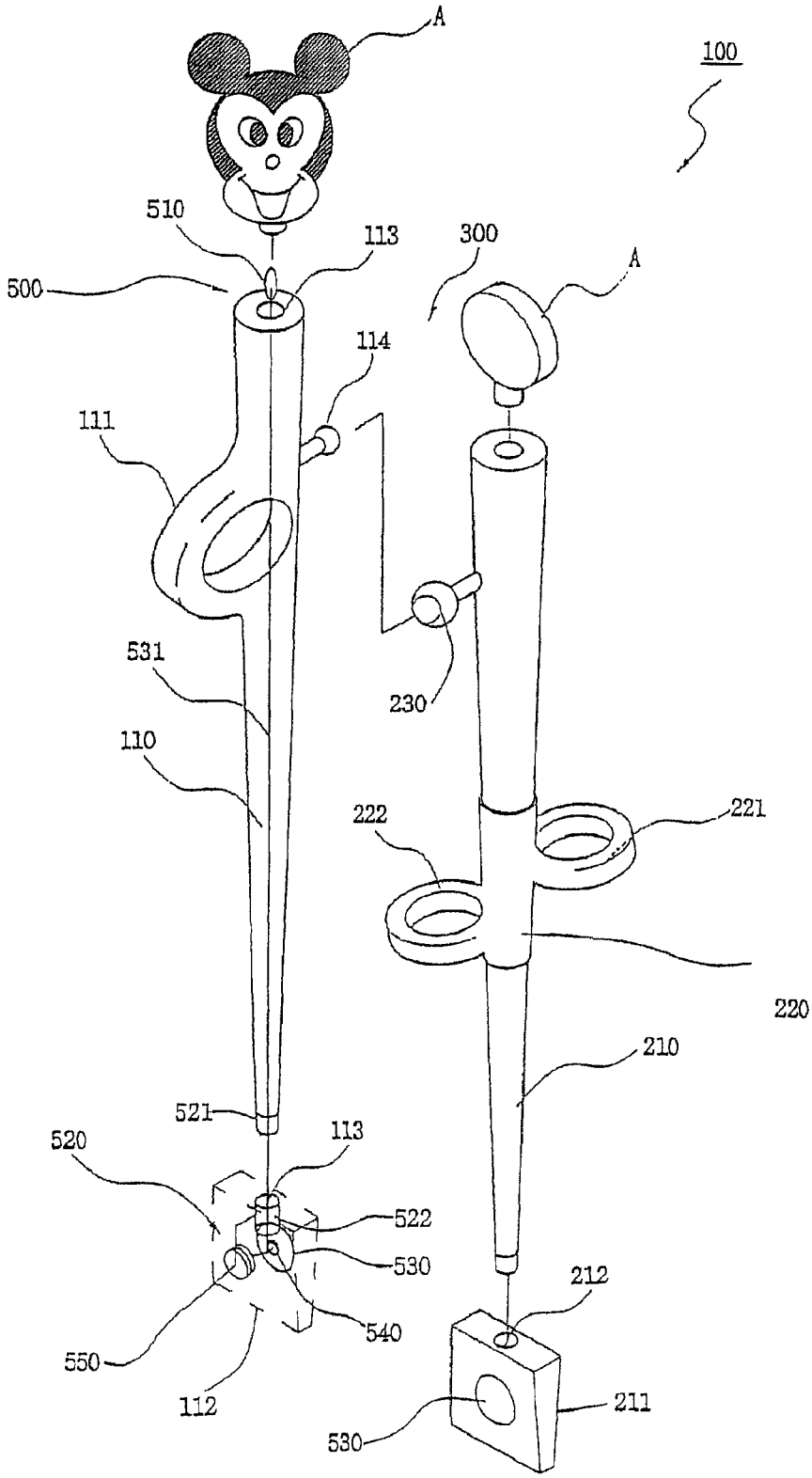
FIG. 8 is an illustrated perspective view showing the training chopsticks according to another embodiment of the present invention.

Another embodiment of training chopsticks 100 of the present invention is shown in FIG. 8 in which the same parts that above embodiment are designated by like reference numerals.

The training chopsticks comprises a first stick 110, a second stick 210, a coupling means 300, and a luminous means 500.

A thumb-inserting ring for inserting the thumb is formed on the upper side of the first stick 110, a first pad 112 for picking up solids is formed on the lower end of the first stick 110, and an ornament A of a character form is formed on the upper end of the first stick 110.

A holding part 220 is formed in the middle of the second stick 210, and a second pad 211 for picking up solids is formed on the lower end of the second stick 210. The holding part 220 comprises a forefinger-inserting ring 221 for inserting the forefinger and a second finger-inserting ring 222 for inserting the second finger. Further, an adjusting means 400 is formed on the second stick 210 so that the coupling position of the holding part 220 is controlled.

The coupling means 300 for coupling the first and the second stick 110, 210 is formed on the upper sides of the first and the second stick 110, 210. The interval between the first and the second stick 110, 210 is kept uniformly by the coupling means 300.

The coupling means 300 comprises an inserting ball 114 formed on the upper side of the first stick 110 and a ball joint 230 formed on the upper side of the second stick 210. The inserting ball 114 can be rotated freely in the ball joint 230.

The luminous means 500 for emitting light is formed in the ornament A. The emission of light through the ornament A is controlled by the pressure between the first and the second pad 112, 211.

As shown FIG. 8, the luminous means 500 has a mounting hole 113 formed through the upper side of the first stick 110, a luminous lamp 510 formed on the upper end of the mounting hole 113, a power supply 520 for providing the luminous lamp 510 with electrical power, a pressure hole 530 formed on the pads 112, 211, a pressure sensor 540 for sensing through the pressure hole 530 and for controlling the operation of the power supply 520 by the sensed pressure.

The power supply 520 has a male connector 521 formed on the lower side of the first stick 110, a female connector 522 for connecting with the male connector 521 and a battery unit 530. The female connector 522 is extended to the pressure sensor 540 and the battery unit 530 is extended to the female connector 522. The male connector 521 and the luminous lamp 510 are connected with a power supplying line 531.

Figure 9A:
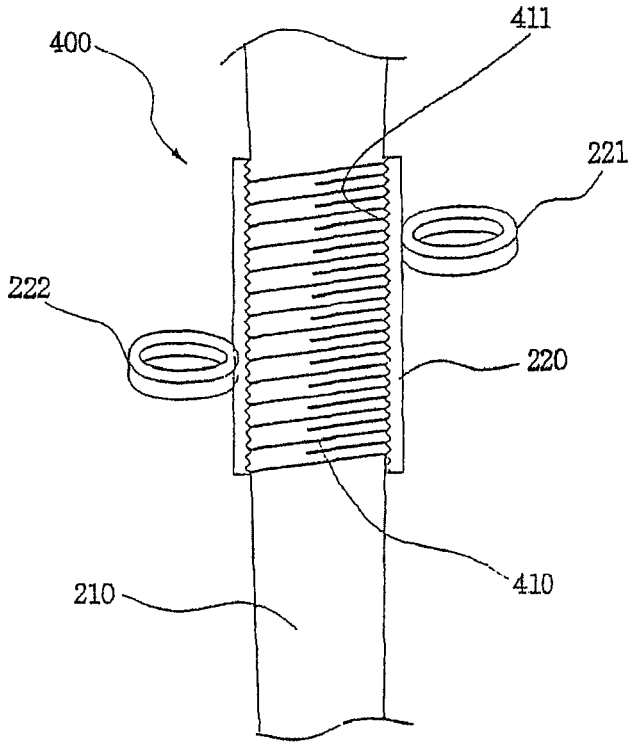
FIGS. 9*a* and 9*b* are schematic views showing a part of an adjusting means of the training chopsticks according to the another embodiment of the present invention.

As shown FIG. 9*a*, the forefinger-inserting ring 221 and the second finger-inserting ring 222 form the holding part 220 as one body. The holding part 220 can be moved up and down with coupling to the second stick 210. The adjusting means 400 has a male screw part 410 formed on the outside of the second stick 210 and a female screw part 411 formed on the inside of the holding part 220, which are engaged each other. By screwing the screw parts 410, 411, the holding part 220 is moved up and down along the second stick 210, so that the position of the holding part 220 is adjusted.

Figure 9B:
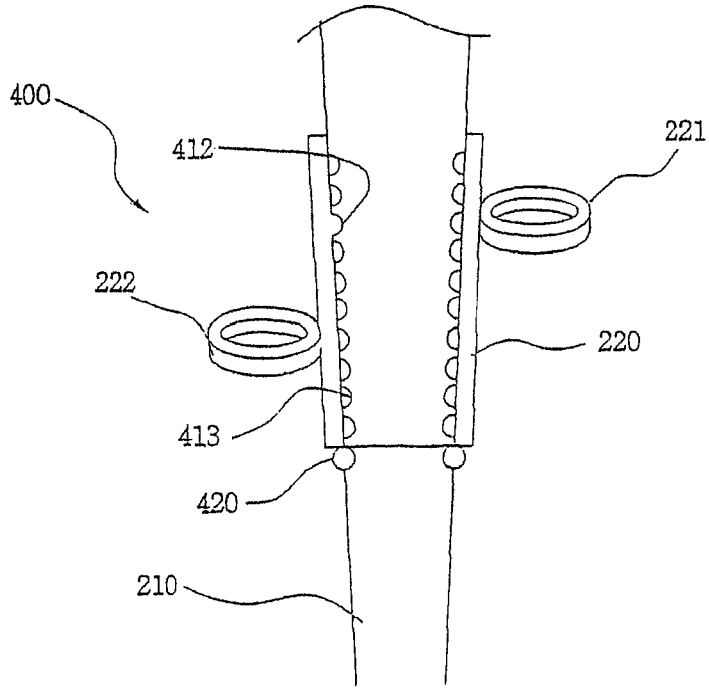

Alternatively, as shown FIG. 9*b*, the position of the holding part 220 may be adjusted by a plurality of fixed grooves 413 and a rubber packing 420. The fixed grooves 413 are formed on the middle side of the second stick 210 at an equal interval, and the rubber packing 420 is elastically adhered on the fixed groove 413 to support the holding part 220. In such a case, the holding part 220 has a protrusion part 412 therein to engage elastically on the fixed grooves 413.

Therefore, it can be adjusted the position of the holding part 220 according to the size of hands. In case of small hands, the holding part 220 is moved up so that the space between the thumb-inserting ring 111 and the forefinger-inserting ring 221 gets narrow. On the contrary, in case of large hands, the holding part 220 is moved down so that the space gets wide. In FIG. 9*a*, the holding part 220 is moved with rotating. On the other hand, in FIG. 9*b*, the holding part 220 is moved to the desired position and then fixed to the fixed groove 413 by coupling the elastic rubber packing 420.

As above described, the position of holding part 220 on the second stick 210 can be adjusted according to the size of user's hand, everyone may use easily the training chopsticks.

An ornament A as products featuring popular characters is formed on the upper ends of the first and the second sticks 110, 210, so that child users have interest in using the chopsticks.

In using the chopsticks of the present invention, novice or child users insert his thumb, forefinger and second finger into the thumb-inserting ring 111, the forefinger-inserting ring 221 and a second finger-inserting ring 222, respectively. Next, when the users grasp his fingers to pick to solids, a grasping pressure is applied to the pressure hole 530 and the pressure sensor 540 senses the pressure so that the luminous lamp 510 is lit by the electrical power of the battery unit 550. If the grasping pressure is weak, the light of the luminous lamp 510 is dimmed or failed. Therefore, the users should grasp firmly the chopsticks 100.

After becoming skillful to some extend, the users make use of the chopsticks without the pads 112, 211. In case of becoming more skillful, the uses make use of the chopsticks without the coupling means 300.

Figure 10A:
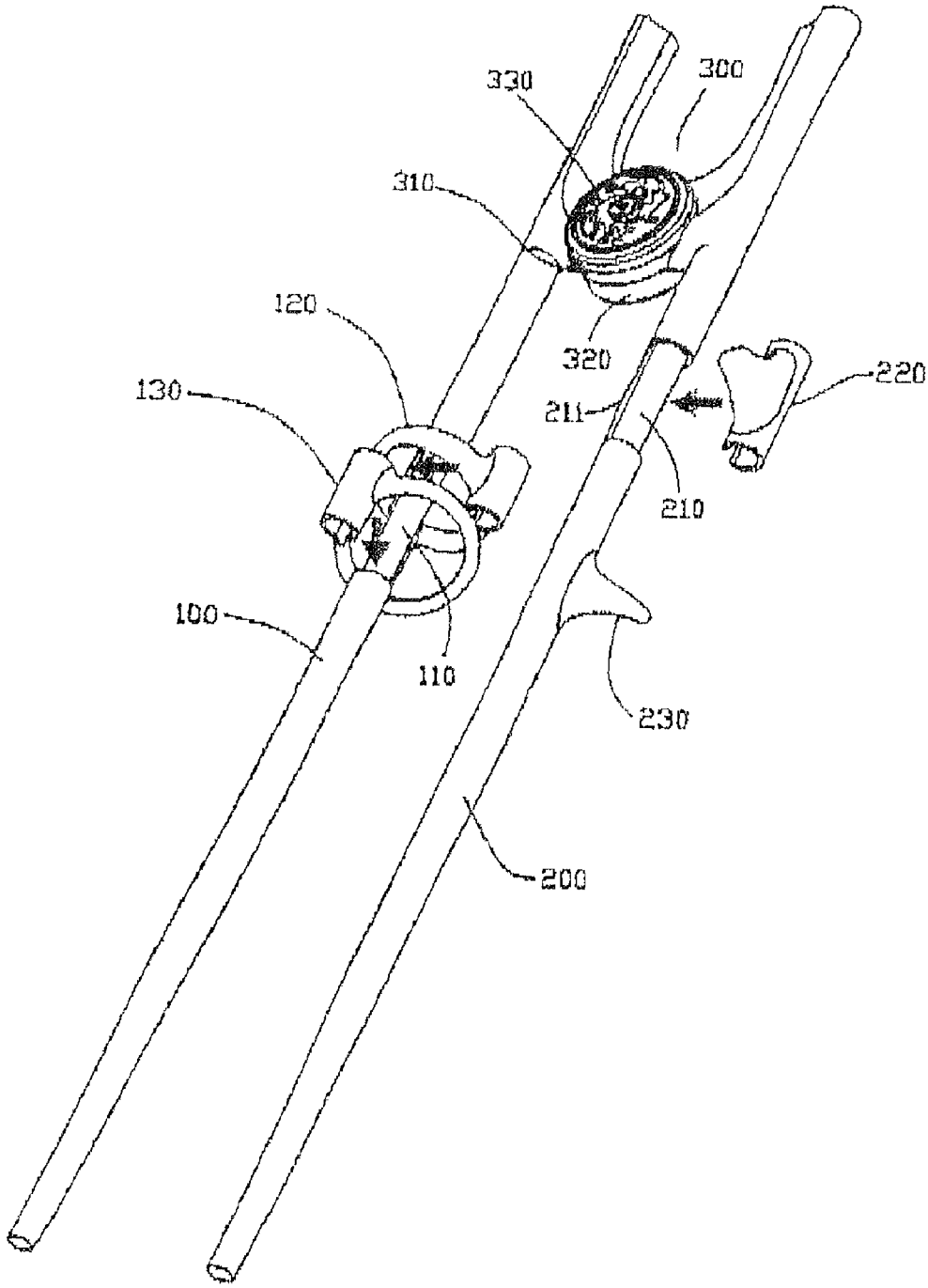
FIG. 10*a* is a perspective view to show a process that a finger inserting holes and finger laying part are attached to the chopsticks and FIG. 10*b* is a drawing to show the chopsticks after the completion of the attaching.

A chopstick 1 in accordance with the present invention with reference to FIG. 10*a*. comprises a first and second sticks 100, 200 wherein a coupling means 300 is provided for maintaining a gap in between the upper parts thereof.

The present invention comprises a rotation-preventing part on the middle of the first stick 100, a first and second finger inserting holes inserted and fixed on the rotation preventing part 110; and a rotation preventing part is formed on the upper part of a second stick 200, and a first finger laying part 220 inserted and fixed on the rotation preventing part 120; and a second finger laying part 230 under a first finger laying part 220 are formed in a unit.

Figure 11A:
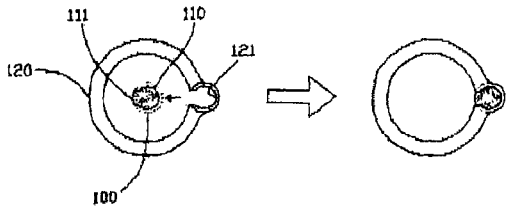
FIGS. 11*a*, 11*b* and 11*c* is an illustrated perspective view showing the training chopsticks according to another embodiment of the present invention.
Figure 11B:
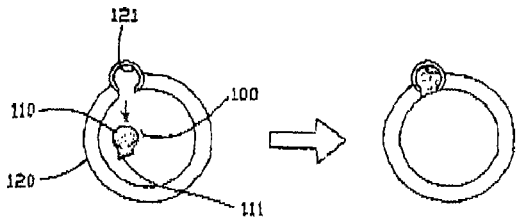

The rotation-preventing parts 110, 210 as illustrated in FIGS. 11*a* and 11*b*, are formed smaller in diameter than the diameter of the first and second sticks 100, 200, and protrusions 111, 211 are formed for preventing each finger inserting holes 120, 130 and finger laying parts 220, 230 from rotating.

Figure 11C:
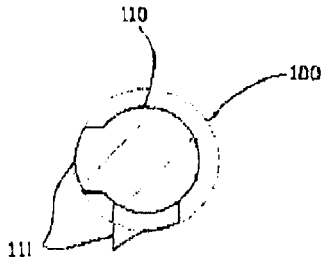

The protrusion 111 formed on the first stick 100 is formed crossing each other as illustrated in FIG. 11*c*.

Figure 10B:
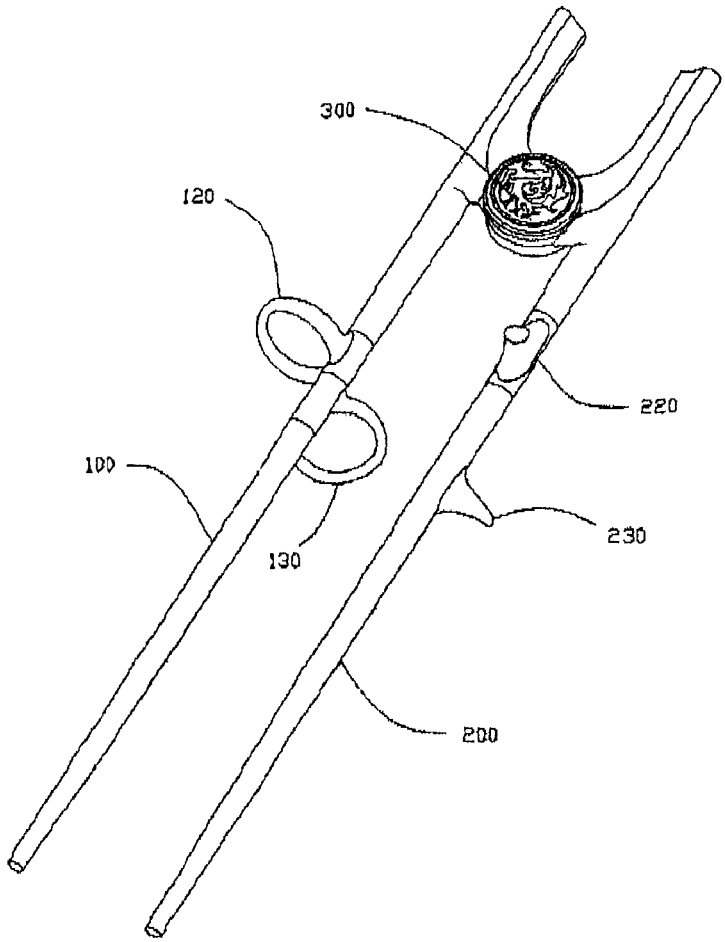

A thumb may be laid on the first finger laying part 220 as illustrated in FIG. 10*a* or FIG. 10*b*, and the upper part of the first finger laying part 220 is a ring shape whose upper part is open and which is replaceable if necessary.

Figure 12A:
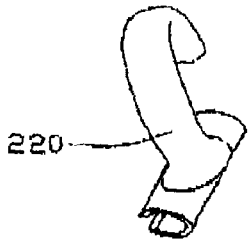
FIG. 12*a*, 12*b* is an illustrated perspective view showing the training chopsticks according to another embodiment of the present invention.
Figure 12B:
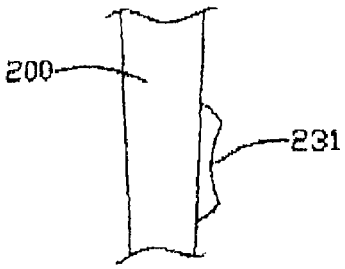

The second finger laying part 230 as illustrated in FIG. 12*b*, further comprises a mounting member equipped corresponding to the first laying part 210 in an opposite direction.

Figure 13:
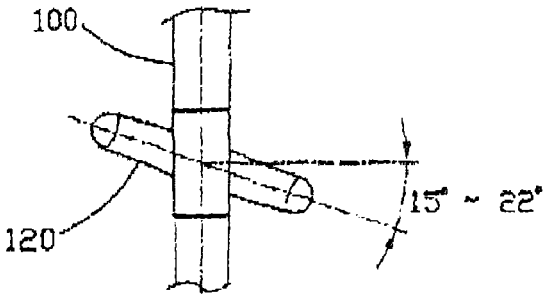
FIG. 13 is an illustrated perspective view showing the training chopsticks for the first finger inserting hole according to embodiment of the present invention.
Figure 14A:
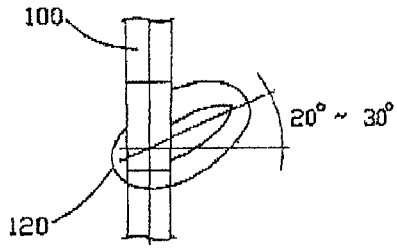
FIGS. 14*a* and 14*b* are perspective views showing a finger-inserting ring of the training chopsticks according to the embodiment of the present invention.
Figure 14B:
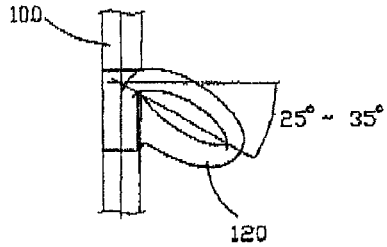

The first and second finger inserting holes 120, 130 as illustrated in FIGS. 13 and 14*b*, is a ring shape slanted on the axis of the first stick, wherein a groove 121 for engaging with the rotation preventing part 110.

The present invention will be described in detail with reference to drawings attached herein.

FIG. 10*a* is a perspective view to show a process that a finger inserting holes and finger laying part are attached to the chopsticks, and FIG. 10*b* is a drawing to show the chopsticks after the completion of the attaching.

Figure 15:
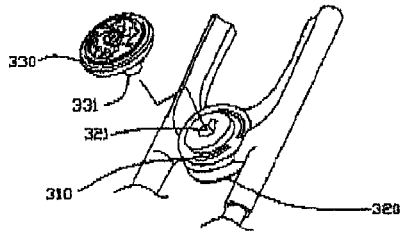
FIG. 15 is schematic views showing a part of a coupling means of the training chopsticks according to the embodiment of the present invention.

The coupling means 300 as illustrated in FIG. 15, comprises a rotating pivotal coupling means 310, a fixed coupling means 320, and a flap for decorating.

In other words, the pivotal coupling means 310 is formed in a unit on the first stick 100, a fixed coupling means 320 in a column shape is formed on a second stick 200, and a pivotal coupling means 310 is engaged on the fixed coupling means 320.

At this time, the flap for decoration 330 for preventing pivotal coupling means 310 from being separated from the fixed coupling means 320 is attached and at the same time a key hole 321 is formed on the middle of the fixed coupling means 320 for preventing the flap for decoration from pivoting, and a key 331 is formed on the flap for decoration 330 for being engaged at a right place.

The key and a step of attaching the key hole can be carried out easily by those who are skilled in the art.

On the other hand, a rotation preventing part 110 is formed on the first stick 100 so that a first and second finger inserting holes for first finger and middle finger 120, 130 are detachably engaged.

For example, the first and second finger inserting holes 120, 130 as illustrated in FIG. 13 to 14*b* have ring shapes slanted on the axis of the first stick 100, and a groove 121 for engaging with the rotation preventing part 110 is formed and engaged as illustrated in FIG. 11*a*.

It is preferable for the first finger inserting hole 110 to be slanted on the first stick 100 at an angle ranging 10 to 20° and for the second finger inserting hole 120 to be slanted at an angle ranging 20 to 25° when viewed from front and to be slanted at an angle 25 to 30° when viewed from side.

At this time, a protrusion 111 is formed on the rotation preventing part 110 to prevent the first and second finger inserting holes 120, 130 from rotating to cause attaching at a right place.

Figure 16:
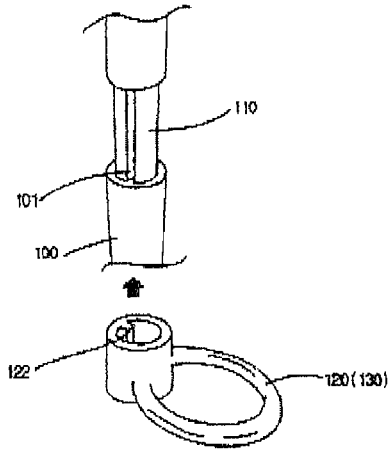
FIG. 16 is a perspective view showing another the first finger-inserting ring and second finger-inserting ring of the training chopstick according to the embodiment of the present invention

Further, the first and second finger inserting holes 120, 130 are formed out of silicon, soft synthetic resin or other elastic materials, a longitudinal groove 101 is formed on the first stick as illustrated in FIG. 16 for preventing rotation in case of soft material like silicon is used, and a protrusion may be formed on the inner side of the first and second finger inserting holes 120, 130.

This can be carried out easily by those who are skilled in the art.

A detachable first finger laying part 220 is formed for a thumb to be inserted or laid on the rotation preventing part of the second stick 200, and a second finger laying part under the first finger laying part is formed.

A user with fingers can easily lay the fingers on the first finger laying part 220 formed as above, and she can insert her thumb easily by opening the upper part as illustrated in FIG. 12*a*.

Further, the second finger laying part 230 as illustrated in FIG. 12*b* comprises a mounting member which is equipped corresponding to the first finger laying part 210 in an opposite direction for third finger to be rested naturally.

Accordingly, any user who are not good at using chopsticks can use the chopstick 100 comprised as above without difficulties.

A beginner in accordance with the presently invented chopstick can use chopstick easily, for example, by inserting first finger and middle finger into the first and second finger inserting holes 120, 130 formed on the first stick 110 and laying thumb on the first finger-laying part 220 of the second stick 210, and laying third finger on the second finger laying part 230.

In accordance with the present invention, a beginner or any user who are poor at using chopsticks can hold solids easily by using the chopsticks 1.

The present invention has the effects as follows.

First, the training chopsticks aids novice or child users to use easily chopsticks and is used as an appliance for rehabilitating.

Second, since the ornament of the training chopsticks emits light, child users take interest in the use of chopsticks and it is easy for an instructor to check how to use the chopsticks properly.

Third, the training chopsticks are used as a game for developing intelligence, for example, the pickup of bead, the pickup of food models, the moving of solids and so on.

Fourth, the repeated using of the training chopsticks provides good exercise for the fingers of users and arouses the brains of users to develop their intelligence.

Fifth, the training chopsticks has a rotated coupling means, that is, the holder formed on the coupling ring is placed on the end of the holding groove of the rotation ring, thereby it is possible to prevent two sticks from passing each other.

Seventh, children or people of non-East Asia origin can use chopsticks at first try and learn how to use the chopstick step by step depending on the user's ability by providing a detachable coupling means to the ends of a pair of chopsticks and inserting and/or laying first finger, middle finger, or thumb, third finger.

Although the present invention has been fully described by way of examples with reference to the accompanying drawings it is to be noted that various changes and modifications will be apparent to those skilled in the art. Therefore, unless such changes and modifications depart from the scope of the present invention, they should be construed as being included therein.

What is claimed is:

1. A pair of training chopsticks for developing intellectual faculties, which comprises:

a first stick having a thumb-inserting ring for inserting the thumb, and a first pad for picking up solids, wherein the thumb-inserting ring is formed on the upper side of the first stick and the first pad is formed on the lower end of the first stick, and the thumb-inserting ring is inclined at 10~35 degrees with respect to the horizontal direction of the first stick;

a second stick having a holding part formed in the middle of the second stick, and a second pad for picking up solids, wherein the holding part has a forefinger-inserting ring for inserting the forefinger and a second finger-inserting ring for inserting the second finger, and the second pad is formed on the lower end of the second stick, wherein the forefinger-inserting ring is inclined at 0~30 degrees and the second finger-inserting ring is inclined at 0~45 degrees with respect to the perpendicular direction of the second stick, respectively; and a coupling means for coupling the first and the second stick at an interval, which is formed on the upper sides of the first and the second stick, wherein the coupling means comprises:

a first coupling member having a first coupling body fixed on the upper side of the first stick, a coupling ring formed as one body with the first coupling body, and a holder formed on the coupling ring.

a second coupling member having a second coupling body fixed on the upper side of the second stick, a rotation ring formed as one body with the second coupling body, a projecting part formed on the rotation ring and inserted into the coupling ring, and a holding groove formed on the rotation ring and engaged with the holder; and a cap fixed into the hole of the second coupling member after the first coupling member and the second coupling member are coupled.

2. A pair of training chopsticks according to claim 1, wherein a portion of the thumb-inserting ring, the forefinger-inserting ring and the second finger-inserting ring are opened respectively.

3. A pair of training chopsticks according to claim 1, wherein the first and second finger-inserting holes are ring shaped and slanted on the axis of the first stick and wherein a locking groove is formed for engaging on the rotation preventing part.

* * * * *